US006668721B2

(12) United States Patent
Naka

(10) Patent No.: US 6,668,721 B2
(45) Date of Patent: Dec. 30, 2003

(54) ROTARY PRINTING PRESS CAPABLE OF NONSTOP PRINTING DURING A CHANGE OF PRINTING PLATES

(75) Inventor: Masahiro Naka, Sakura (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 4 days.

(21) Appl. No.: 10/067,371

(22) Filed: Feb. 7, 2002

(65) Prior Publication Data

US 2002/0121202 A1 Sep. 5, 2002

(30) Foreign Application Priority Data

Mar. 5, 2001 (JP) ..... 2001-060182

(51) Int. Cl.[7] ..... B41F 7/02; B41F 5/00; B41F 11/02

(52) U.S. Cl. ..... 101/218; 101/135; 101/136; 101/216; 101/328; 101/375; 101/475; 101/378; 101/382.1

(58) Field of Search ..... 101/218, 216, 101/328, 475, 375, 378, 382.1, 135, 136

(56) References Cited

U.S. PATENT DOCUMENTS

| | | | | | |
|---|---|---|---|---|---|
| 4,753,168 | A | * | 6/1988 | Theilacker et al. | 101/177 |
| 4,864,927 | A | * | 9/1989 | Niehaus | 101/181 |
| 5,235,910 | A | * | 8/1993 | Tafel | 101/217 |
| 5,381,734 | A | * | 1/1995 | Becker | 101/247 |
| 5,590,597 | A | * | 1/1997 | Balow | 101/216 |
| 5,813,336 | A | * | 9/1998 | Guaraldi et al. | 101/218 |
| 5,826,505 | A | * | 10/1998 | Volz et al. | 101/183 |
| 5,983,794 | A | * | 11/1999 | Emery | 101/177 |
| 6,085,651 | A | * | 7/2000 | Derance et al. | 101/247 |
| 6,205,926 | B1 | * | 3/2001 | Duour | 101/492 |
| 6,216,592 | B1 | * | 4/2001 | Knauer et al. | 101/247 |
| 6,289,805 | B1 | * | 9/2001 | Douillard et al. | 101/247 |

FOREIGN PATENT DOCUMENTS

| | | |
|---|---|---|
| JP | 3-47886 | 10/1991 |
| JP | 2589863 | 12/1996 |

* cited by examiner

*Primary Examiner*—Andrew H. Hirshfeld
*Assistant Examiner*—Marvin P Crenshaw
(74) *Attorney, Agent, or Firm*—Wenderoth, Lind & Ponack, L.L.P.

(57) ABSTRACT

A rotary offset printing press which has a series of printing units of identical make through which a web of paper is threaded. In each printing unit the blanket cylinder is made displaceable into and out of printing engagement with the plate cylinder and the impression cylinder. The cylinders of each printing unit are driven from a separate variable-speed motor via a train of gears which stay intermeshed whether the blanket cylinder is in or out of printing engagement with the other cylinders. A clutch is inserted between the drive linkage and the impression cylinder for connecting and disconnecting the latter to and from the former. A plate change is possible in any of the printing units by moving the blanket cylinder out of printing engagement with the plate cylinder and the impression cylinder, and declutching the impression cylinder from the drive linkage, in that printing unit while the other printing unit or units are in continuous operation for printing the web.

9 Claims, 2 Drawing Sheets

ROTARY PRINTING PRESS CAPABLE OF NONSTOP PRINTING DURING A CHANGE OF PRINTING PLATES

BACKGROUND OF THE INVENTION

This invention relates to printing presses in general and, in particular, to a rotary printing press providing for a change of printing plates without a pause in printing.

The concept of a printing press capable of nonstop operation during a change of printing plates is itself not new. Japanese Utility Model Publication No. 3-47886 and Japanese Patent No. 2,589,863 are hereby cited as teaching printing presses constructed toward that end. These prior art machines are alike in having two plate cylinders independently movable into and out of printing engagement with an impression cylinder, either directly or via a blanket cylinder. When either plate cylinder is in printing engagement with the impression, or blanket, cylinder, the other plate cylinder is held away therefrom and declutched from the power transmission system of the press for a change from one printing plate to another. Upon mounting of a new printing plate, the plate cylinder is driven at a peripheral speed matching the printing speed and moved back into printing contact with the impression, or blanket, cylinder, from which the plate cylinder that has so far been in use is moved away.

Despite the compactness of the cylinder configuration according to the noted prior art machines, they do, however, possess some shortcomings that are in urgent need of rectification. First, in these prior art machines, the rotational speed of the impression cylinder is the norm in reference to which the rotations of the plate cylinders and blanket cylinder are controlled. The plate cylinders required clutches and speed control means of very complex constructions as they were individually moved into and out of printing engagement with the impression cylinder.

According to Japanese Patent No. 2,589,863, supra, in particular, a plurality of plate cylinders are arranged at circumferential spacings around one impression, or blanket, cylinder for making as many different printings at the same time, thereby providing for a change in shop name or the like within one printing unit. This construction almost made it impossible to make interchangeable use of different diameter sets of plate cylinders and blanket cylinders.

The rotary printing press constructed for interchangeable use of different size cylinders has itself been known. When this type of press is constituted of a series of printing units of identical make, the driving of the impression cylinders of all the printing units from one common drive shaft for synchronization purposes is undesirable, because then the plate cylinders and blanket cylinders have to be driven separately at the cost of very complex and duplicate means.

SUMMARY OF THE INVENTION

An aim of the present invention is the provision of a rotary printing press that permits a nonstop printing during a change of printing plates with use of simple drive and speed control means.

Another object of the invention is to adapt the printing press, having the capability set forth above, for interchangeable use of different diameter sets of cylinders.

Briefly, the invention provides a rotary printing press capable of nonstop printing during a change of printing plates, which comprises a series of printing units through which a web of paper or the like is to be threaded one after another in order to be printed. Each printing unit comprises in its simplest form a plate cylinder and an impression cylinder, the plate cylinder being movable into and out of printing engagement with the impression cylinder. Also provided for each printing unit, a drive motor is coupled by a drive linkage to the plate cylinder and thence, via a clutch, to the impression cylinder regardless of whether the plate cylinder is in or out of printing engagement with the impression cylinder.

Such being the construction of the two or more printing units constituting the printing press according to the invention, a plate change is possible in any of the printing unit while the other printing unit or units print the web. Any desired printing unit can be conditioned for a plate change merely as the plate cylinder is moved out of printing engagement with the impression cylinder, and the impression cylinder declutched from the drive linkage. During the subsequent progress of a plate change, the impression cylinder stays in the same position as when printing was being made in this printing unit. Furthermore, being declutched from the drive linkage, the impression cylinder is free to rotate in frictional contact with the web, holding the same under the same tension as before and so enabling the other printing unit or units to print the web without a hitch.

The printing units according to the invention are each much simpler in construction than the prior art machine in which a plurality of plate cylinders are selectively moved into and out of printing engagement with the impression cylinder or with the blanket cylinder. Each printing unit is made even simpler by the provision of a dedicated drive motor and dedicated drive linkage for the cylinders.

In the preferred embodiment of the invention to be disclosed herein, each printing unit takes the form of an offset press, itself well known in the art, comprising a plate cylinder, a blanket cylinder and an impression cylinder. The blanket cylinder is made movable into and out of printing engagement with the plate cylinder and the impression cylinder in this application of the invention. The impression cylinder occupies the same position during a plate change as during printing and, declutched from the drive linkage, serves as a tension roller for the web as the latter is printed in the other printing unit or units.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENT

The present invention will now be described as embodied in the offset printing press system of FIG. 1 having a series of, four in this particular embodiment, printing units 1*a*, 1*b*, 1*c* and 1*d* of identical design. A web of paper 2 travels through these printing units 1*a*–1*c* one after another thereby to be printed on one side. Each printing unit is constructed for a change of printing plates without suspending the printing operation of the other printing units, and, as an ancillary feature of the invention, for interchangeable use of different-diameter sets of cylinders. The set of printing cylinders now shown mounted to each printing unit should be understood to represent one of such interchangeable sets of cylinders.

Figure 2:
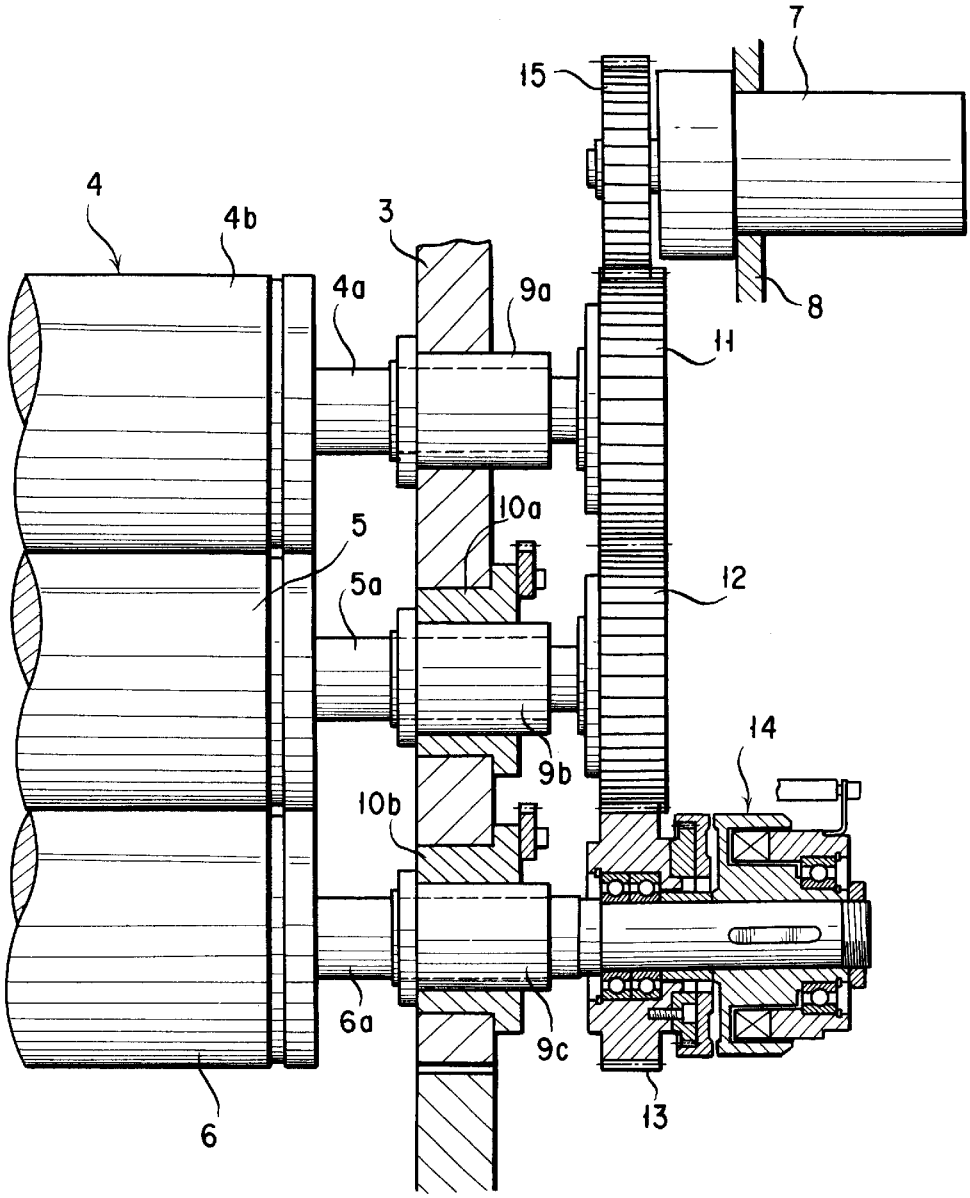
FIG. 2 is an enlarged, fragmentary section through one of the printing units of the FIG. 1 press, showing in particular how the blanket cylinder is moved into and out of printing engagement with the plate cylinder and impression cylinder, and how the cylinders are driven.

As shown in more detail and on an enlarged scale in FIG. 2, each of the printing units 1*a*–1*d* has a replaceable pair of cylinder side walls 3, one seen, between which there are rotatably supported a plate cylinder 4, a blanket cylinder 5 and an impression cylinder 6. All these cylinders 4–6 are driven from a sectional motor 7 mounted to an outer side wall 8 of each individual printing unit.

The plate cylinder 4, blanket cylinder 5 and impression cylinders 6 are shown in FIG. 2 as having trunnions 4*a*, 5*a* and 6*a* extending coaxially therefrom and rotatably journaled in bearings 9*a*, 9*b* and 9*c*, respectively, on the cylinder side wall 3. The bearing journaled 9*a* is mounted directly to the cylinder side wall 3. The other two bearings 9*b* and 9*c*, however, are mounted thereto via eccentric sleeves 10*a* and 10*b* which are rotatable relative to the cylinder side wall. These eccentric sleeves are so named because they have hollows cut eccentrically therethrough for receiving the bearings 9*b* and 9*c*. Although, FIG. 2 shows how the cylinders 4–6 are supported each at one end only, it is understood that the other ends of the cylinders are likewise supported.

Consequently, with the turn of the pairs of eccentric sleeves 10*a* and 10*b* relative to the pair of cylinder side walls 3, the blanket cylinder 5 and impression cylinder 6 are displaceable relative to each other and to the plate cylinder 4. The pair of eccentric sleeves 10*a* carrying the blanket cylinder 5 are to be bidirectionally turned through an angle such that the blanket cylinder is moved into and out of printing engagement with both plate cylinder 4 and impression cylinder 6, thereby conditioning the printing unit under consideration for printing or for a plate change. The other pair of eccentric sleeves 10*b* carrying the impression cylinder 6 is to be bidirectionally turned, as an ancillary feature of the invention, for adjustment of the printing pressure exerted on the web 2 as it passes between blanket cylinders 5 and impression cylinder 6. In practice a fluid-actuated cylinder or the like may be operatively coupled to each of the eccentric sleeves 10*a* and 10*b* for bidirectionally revolving the same relative to the cylinder side wall 3.

Projecting outwardly of the bearings 9*a* and 9*b*, the plate cylinder trunnion 4*a* and blanket cylinder trunnion 5*a* have driven gears 11 and 12 nonrotatably mounted thereon. The plate cylinder gear 11 is in mesh with a drive gear 15 on the output shaft of the sectional motor 7 and with the blanket cylinder gear 12. So driven by the plate cylinder gear 11, the blanket cylinder gear 12 drives in turn still another driven gear 13. This third driven gear 13 is rotatably mounted on the impression cylinder trunnion 6*a* via a clutch 14 which preferably is actuated electromagnetically, so that the impression cylinder 6 is driven from the sectional motor 7 only when the clutch 14 is engaged. The pitch circles of the three cylinder gears 11–13 are equal in diameter to the cylinders 4–6, respectively.

The plate cylinder 4, blanket cylinder 5 and impression cylinder 6 are to be separated as aforesaid from one another as for a change of the printing plate 4*b* on the plate cylinder. It is understood that the gears 11–13 stay in mesh with another upon displacement of the blanket cylinder 5 out of printing engagement with the plate cylinder 4 and impression cylinder 6. At least the plate cylinder 4 and blanket cylinder 5 are therefore drivable from the sectional motor 7 even when the three cylinders 4–6 are out of contact with one another.

As has also been stated, each of the printing units 1*a*–1*d* of this representative embodiment of the invention is constructed for use with interchangeable sets of different-diameter cylinders, each such set being complete with a pair of cylinder side walls similar to that shown at 3 in FIG. 2 and with driven gears similar to those depicted at 11–13 in the same figure. As will be understood from FIG. 1, the driven gear 11 of any such interchangeable cylinder set is movable into and out of driven engagement with the drive gear 15 with the mounting and dismounting of the cylinder set.

Figure 1:
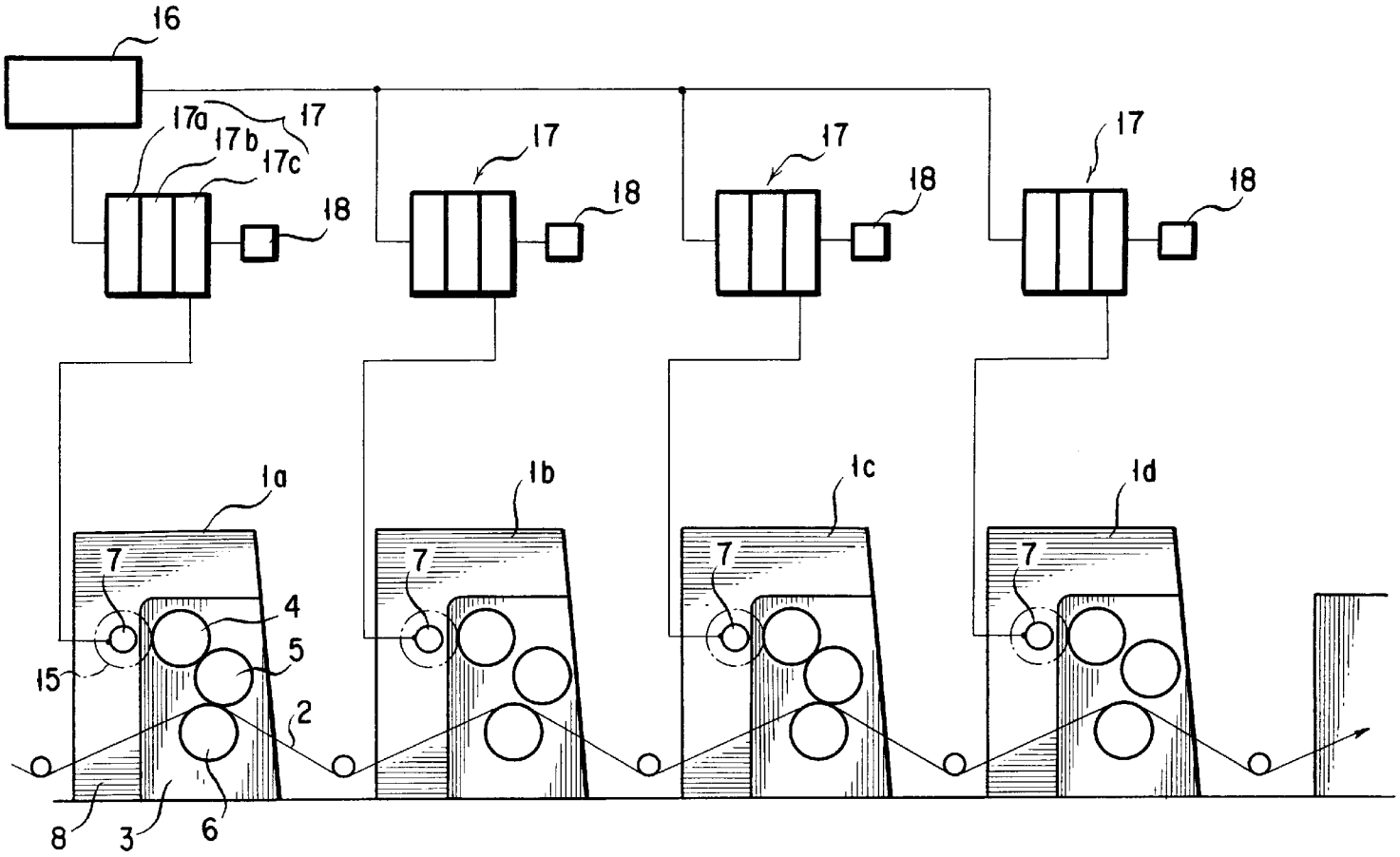
FIG. 1 is a schematic illustration, partly in block-diagrammatic form, of the offset printing press embodying the novel concepts of this invention.

As indicated block-diagrammatically in FIG. 1, the sectional motors 7 of all the printing units 1*a*–1*c* operate under the direction of a master controller 16 via respective auxiliary controllers 17. The master controller 16 controls the motors 7 for rotation at a prescribed speed. Each auxiliary controller 17 has a clutching control section 17*a* for setting each motor into and out of rotation despite the constant speed control of the master controller 16, a speed control section 17*b* for fine speed adjustment of each motor, and an acceleration control section 17*c* for accelerating each motor from a standstill to the prescribed speed of the master controller 16. Manual control means 18 are connected to each auxiliary controller 17 for manual control of its constituent sections 17*a* 17*c*.

Operation

In FIG. 1 are shown the first and third printing unit 1*a* and 1*c* in the act of printing the web 2, and the second and fourth printing units 1*b* and 1*d* conditioned for changing the printing plates 4*b* on their plate cylinders 4; that is, a plate change is in progress at the second and fourth printing units while the first and third printing units are printing nonstop. The second and fourth printing units 1*b* and 1*d* are conditioned for a plate change as their electromagnetic clutches 14 are disengaged, and at the same time as the pair of eccentric sleeves 10*a* of each unit are turned to carry the blanket cylinder 5 out of rolling engagement with the plate cylinder 4 and impression cylinder 6. Declutched from the drive motors, and with the displacement of the blanket cylinders 5 out of printing engagement therewith, the impression cylinders 6 of both printing units 1*b* and 1*d* will become free to rotate and so serve as tension rollers as the web 2 travels through these printing units while being printed in the other printing units 1*a* and 1*c*.

For dismounting the printing plate 4*b* from, and mounting a new printing plate to, the plate cylinder 4 in each of the printing units 1*b* and 1*d*, the plate cylinder may be turned slowly, either by the sectional motor 7 or, with this motor set out of rotation, manually. Such a plate change will be easier as the blanket cylinder 5 is now out of contact with the plate cylinder 4.

Upon completion of the plate change the sectional motors 7 of the printing units 1*b* and 1*d* may both be set into rotation again when the printings yet to be made by the other printing units 1*a* and 1*c* decrease to a prescribed number. The motors 7 may be accelerated and finely controlled to match the peripheral speed of the plate cylinders 4 and blanket cylinders 5 to the running speed of the web 2 and to phase the cylinders to the web. Then the electromagnetic clutches 14 may be re-engaged to connect the sectional motors 7 to the impression cylinders 6, it being understood that the gears 11–13 and 15 remain in mesh even when the blanket cylinders 5 are displaced out of contact with the plate cylinders 4 and impression cylinders 6.

The printing units 1*b* and 1*d* may be put back to operation when the other printing units 1*a* and 1*c* have completed their printing assignment. All that is needed to this end is to turn the eccentric sleeves 10*a* back to their initial positions where the blanket cylinders 5 come into printing engagement with the plate cylinders 4 and impression cylinders 6. The images on the newly mounted printing plates 4*b* on the plate cylinders 4 of the printing units 1*b* and 1*d* will now be printed on the web 2.

Perhaps concurrently with the commencement of printing by the printing units 1*b* and 1*d*, the eccentric sleeves 10*a* of the other printing units 1*a* and 1*c* may be revolved to carry their blanket cylinders 5 out of printing engagement with the plate cylinders 4 and impression cylinders 6. Further the impression cylinders 6 of the printing units 1*a* and 1*c* may be declutched from the drive motors 7, and these motors set out of rotation. The shift has now been completed from printing units 1*a* and 1*c* to printing units 1*b* and 1*d*. A plate change may subsequently be made in the printing units 1*a* and 1*c* by the same procedure as explained above for the printing units 1*b* and 1*d*.

The representative embodiment of the present invention set forth hereinabove is meant purely to illustrate or explain and not to impose limitations upon the invention. For instance, the cylinders may not necessarily be exchangeable in each printing unit. It is also understood that the present invention is applicable to an apparatus in which each printing unit has but two cylinders, a plate cylinder in direct printing engagement with an impression cylinder. The plate cylinder may then be rendered movable into and out of printing engagement with the impression cylinder. All these and other modifications, alterations and adaptations of the invention may be resorted to without departure from the fair meaning or proper scope of the claims which follow.

What is claimed is:

1. A rotary printing press capable of nonstop printing during a change of printing plates, comprising:

(A) a series of printing units through which a web of paper or the like is to be threaded one after another in order to be printed, each printing unit comprising:

(a) a plate cylinder having a printing plate replaceably mounted thereon;

(b) an impression cylinder coacting with the plate cylinder for printing the web;

(c) support means for supporting the plate cylinder for movement into and out of printing engagement with the impression cylinder;

(d) variable speed drive means including a drive motor;

(e) a drive linkage for power transmission from the drive motor to the plate cylinder and thence to the impression cylinder regardless of whether the plate cylinder is in or out of printing engagement with the impression cylinder; and (f) a clutch inserted between the drive linkage and the impression cylinder for connecting and disconnecting the latter to and from the former;

(B) wherein the printing plate on the plate cylinder can be changed in any of the printing units by moving the plate cylinder out of printing engagement with the impression cylinder, and declutching the impression cylinder from the drive linkage, in that printing unit while the other printing unit or units are in continuous operation for printing the web.

2. The rotary printing press of claim 1 wherein the drive linkage is a train of gears which are in mesh with one another both when the plate cylinder is in and out of printing engagement with the impression cylinder.

3. The rotary printing press of claim 1 wherein the plate cylinder and the impression cylinder are supported by and between a replaceable pair of cylinder side walls.

4. The rotary printing press of claim 1, wherein the series of printing units comprises more than two printing units.

5. A rotary offset printing press capable of nonstop printing during a change of printing plates, comprising:

(A) a series of printing units through which a web of paper or the like is to be threaded one after another in order to be printed, each printing unit comprising:

(a) a plate cylinder having a printing plate replaceably mounted thereon;

(b) an impression cylinder;

(c) a blanket cylinder disposed between the plate cylinder and the impression cylinder for receiving an inked image from the plate cylinder and transferring the same to the web passing between the impression cylinder and the blanket cylinder;

(d) support means for supporting the blanket cylinder for displacement into and out of printing engagement with the plate cylinder and the impression cylinder;

(e) variable speed drive means including a drive motor;

(f) a drive linkage for power transmission from the drive motor to the plate cylinder, thence to the blanket cylinder and thence to the impression cylinder regardless of whether the blanket cylinder is in or out of printing engagement with the plate cylinder and the impression cylinder; and (g) a clutch inserted between the drive linkage and the impression cylinder for connecting and disconnecting the latter to and from the former;

(B) wherein the printing plate on the plate cylinder can be changed in any of the printing units by causing the blanket cylinder to go out of printing engagement with the plate cylinder and the impression cylinder, and declutching the impression cylinder from the drive linkage, in that printing unit while the other printing unit or units are in continuous operation for printing the web.

6. The rotary offset printing press of claim 5 wherein the support means of each printing unit comprises:

(a) frame means;

(b) a pair of eccentric sleeves mounted to the frame means for rotatably and eccentrically supporting the blanket cylinder at opposite ends thereof, the pair of eccentric sleeves being rotatable relative to the frame means for causing displacement of the blanket cylinder into and out of printing engagement with the plate cylinder and the impression cylinder.

7. The rotary offset printing press of claim 6 further comprising a second pair of eccentric sleeves mounted to the frame means for rotatably and eccentrically supporting the impression cylinder at opposite ends thereof, the second pair of eccentric sleeves being rotatable relative to the frame means for adjustment of printing pressure on the web as the latter passes between the impression cylinder and the blanket cylinder.

8. The rotary offset printing press of claim 6 wherein the frame means comprises a replaceable pair of cylinder side walls between which the plate cylinder and the blanket cylinder and the impression cylinder are supported.

9. The rotary offset printing press of claim 5, wherein the series of printing units comprises more than two printing units.

* * * * *